United States Patent [19]

Mattle

[11] Patent Number: 4,988,213

[45] Date of Patent: Jan. 29, 1991

[54] PACKING BAG MADE FROM A FILM TUBE

[75] Inventor: Helmut Mattle, Gronau, Fed. Rep. of Germany

[73] Assignee: M & W Verpackungen Mildenberger & Willing GmbH & Co., Gronau, Fed. Rep. of Germany

[21] Appl. No.: 367,941

[22] Filed: Jun. 19, 1989

[30] Foreign Application Priority Data

Jun. 18, 1988 [DE] Fed. Rep. of Germany ... 8807896[U]

[51] Int. Cl.[5] ..... B65D 33/14

[52] U.S. Cl. ..... 383/6; 383/13; 383/22; 383/120; 206/554; 206/806; 493/226; 493/926

[58] Field of Search ..... 383/6, 12, 13, 18, 21, 383/22, 25, 67, 119, 120; 206/554, 806; 493/194, 195, 226, 926

[56] References Cited

U.S. PATENT DOCUMENTS

| | | | |
|---|---|---|---|
| 3,044,233 | 7/1962 | Altman, Jr. | 206/554 X |
| 3,312,339 | 4/1967 | Million | 206/554 X |
| 3,317,037 | 5/1967 | Russell | 206/554 X |
| 4,207,983 | 6/1980 | Wolske | 206/554 |
| 4,690,280 | 9/1987 | Meyer | 206/554 |
| 4,759,639 | 7/1988 | DeMatteis | 383/120 X |
| 4,779,996 | 10/1988 | Sengewald | 383/120 X |

FOREIGN PATENT DOCUMENTS

| | | | |
|---|---|---|---|
| 1280724 | 11/1961 | France | 383/22 |
| 1464148 | 11/1966 | France | 206/554 |
| 2430362 | 3/1980 | France | 383/119 |

*Primary Examiner*—Stephen Marcus
*Assistant Examiner*—Jes F. Pascua
*Attorney, Agent, or Firm*—Felfe & Lynch

[57] ABSTRACT

A packing bag (1), which is open-ended for filing purposes, is made from a film tube and has a removable film tab (10) at its open end (4). The tab is connected to the flat side (5) of the bag by a weld seam. The tab is provided with two wicket perforations (6, 7) and has an additional score line (12) between the wicket perforations and weld seam (9).

4 Claims, 2 Drawing Sheets

PACKING BAG MADE FROM A FILM TUBE

BACKGROUND OF THE INVENTION

The invention relates to a packing bag made from a film tube cut to length and open-ended for filling purposes. The open end is provided with at least one removable film element having at least one wicket perforation. Such a bag can be made of paper or plastic film.

As disclosed, for example, in the U.S. Pat. No. 4,669,251, such a film bag can be stacked on a wicket and can be unfolded during the filling process. For this purpose, a wicket perforation and a corresponding cutout are punched in the paper or plastic film web at regular intervals and at the same levels before it is folded. The position of a cutout to the adjacent wicket perforations, which are at the same level, are selected so that the film tube cutout is situated above the wicket perforations which are thus exposed. After filling the packing bag the wicket area and the overhanging film tube are cut away in a cut-weld operational step.

The term "film tube", as used herein is to be understood to mean an originally tube-like extruded double web as well as the one with the margins joined to form such a double web.

The known packing bag described above has the disadvantage that a relatively large amount of waste packing material is developed. Although this material can be recycled, the wastage is significant.

SUMMARY OF THE INVENTION

A principal object of the present invention is to reduce or possibly avoid wastage resulting from removing film with the wicket perforations.

This object, as well as other objects which will become apparent from the discussion that follows, are achieved, according to the invention, by a film tube bag whose film element consists of at least one tab, with a wicket perforation, which is connected to a flat side at the open end of the bag.

Hence, the bag configuration in accordance with the invention is not based on a bag where the film tube material itself is provided with a wicket perforation but where an additional part having the perforation is glued on, welded on or fixed in any other way. The additional part, which is referred to as a "tab", can, for example, be a waste cutout which is correspondingly cut to size and provided with perforations. A rectangular configuration of the "tab" is preferred; however, it can also be polygonal, e.g. rhombic or triangular.

Preferably, the tab is fixed to the outer side of the bag. However, it is also possible to fix it to the inside; e.g., to avoid damage or fouling of the outer side.

If the film is configured as a rectangular or parallel strip, one of its longitudinal sides is disposed parallel to the cutting edge of the tube. The wicket perforations, preferably two, can be on one single tab; however, its also possible that the number of tabs corresponds to the number of wicket perforations with each tab having one perforation, with the tabs being disposed on the flat side of the bag.

As already indicated, it is advantageous that the tab supporting the wicket perforation can be torn off or removed from the flat side of the bag. This permits the manufacturer to take back the tabs which are stacked on the wicket prongs in their entirety and to reuse these tabs for the same purpose.

It is also possible to provide the tab with an additional score line situated between the wicket perforation and where the tab is welded to the bag which advantageously permits the tab to be torn off.

For a full understanding of the present invention, reference should now be made to the following detailed description of the preferred embodiments of the invention and to the accompanying drawings.

DESCRIPTION OF THE PREFERRED EMBODIMENTS

The bag 1 made from a film tube consists of paper, plastic or, if desired, of a composite material which is suitable for packing purposes. Basically, any web-like material used for packing can be employed.

Figure 1:
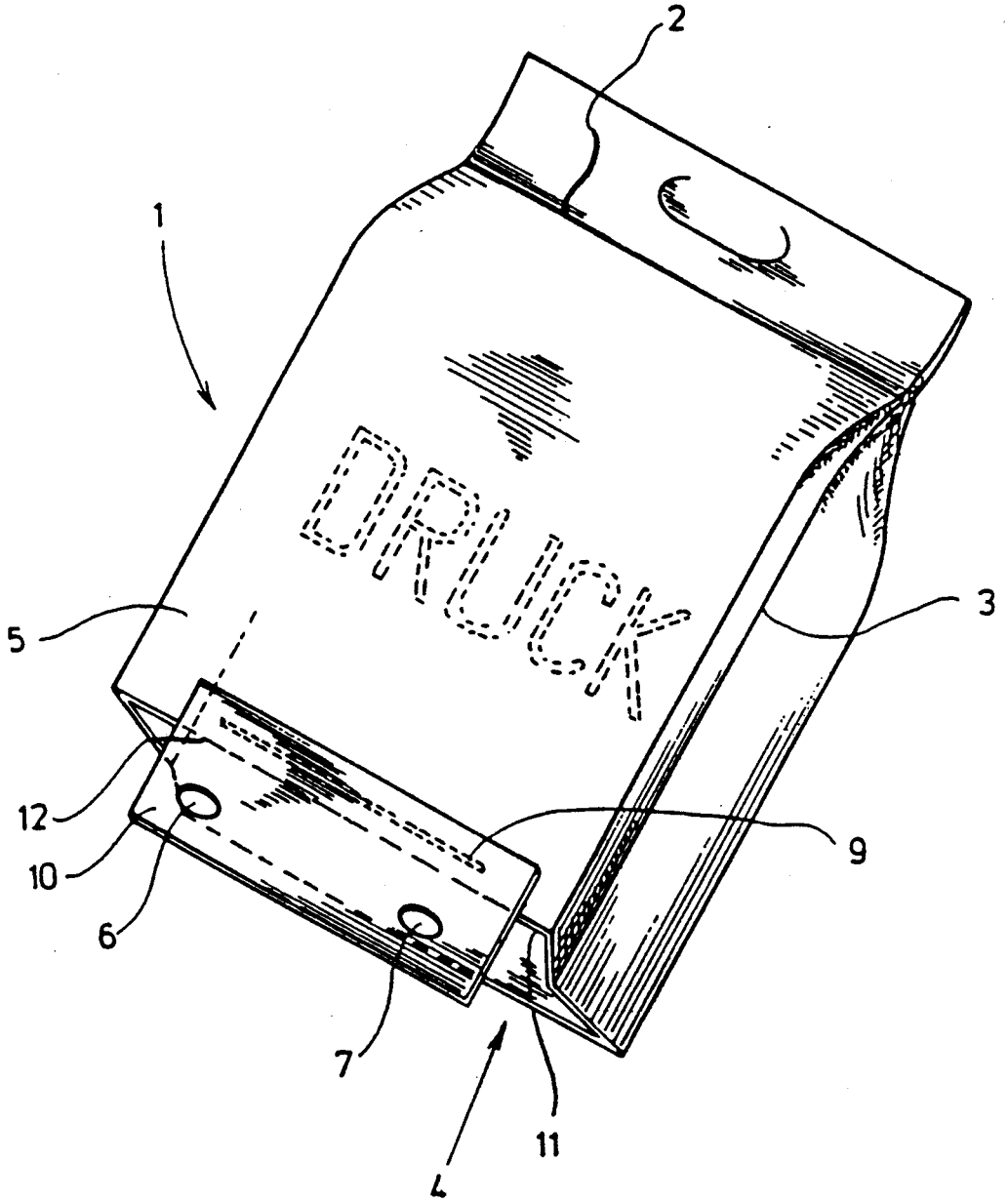
FIG. 1 is a perspective view of a packing bag in its first embodiment (one tab with two wicket perforations).

On its top end the bag 1 is closed by a transverse weld seam 2 as is illustrated in FIG. 1. The lateral walls are slightly turned to the inside by an inside fold 3. The bottom end 4 is open. The present example demonstrates a configuration just before the filling process starts. Before the filling starts, the bag is inflated by an airflow.

A rectangular tab 10 with wicket perforations 6, 7 is disposed on the bottom end area of one of the flat sides 5. The longitudinal side of the tab 10 is parallel to the cutting edge 11 of the bag 1. The tab 10 consists of a plastic film material, which usually corresponds to or is at least similar to the material of the bag 1; however, the material is not subject to printing or further processing. It can be a waste cutout, for example. The wicket perforations 6, 7 have the conventional distance and dimensions to fit with the conventional wicket prongs.

A weld seam 9 connects the tab 10 to the outer sides of the bag. The weld seam is applied as close as possible to the edge 11 of the open end so as to integrate the overhanging part of the tab in the bottom area when the latter is folded; i.e. it is integrated and welded into the bottom area in order to additionally reinforce the bottom area.

In addition, the tab 10 is provided with a score line 12 permitting one to tear the bags off of the wicket in a simple way and avoiding any damage once they are mechanically filled. One part of the tab remains at the wicket prongs.

It should be pointed out in particular that a tab 10 can be provided which can be removed or torn off in its entirety from the bag. After the filling and the removal from the wicket it remains on the latter and can be reused.

Figure 2:
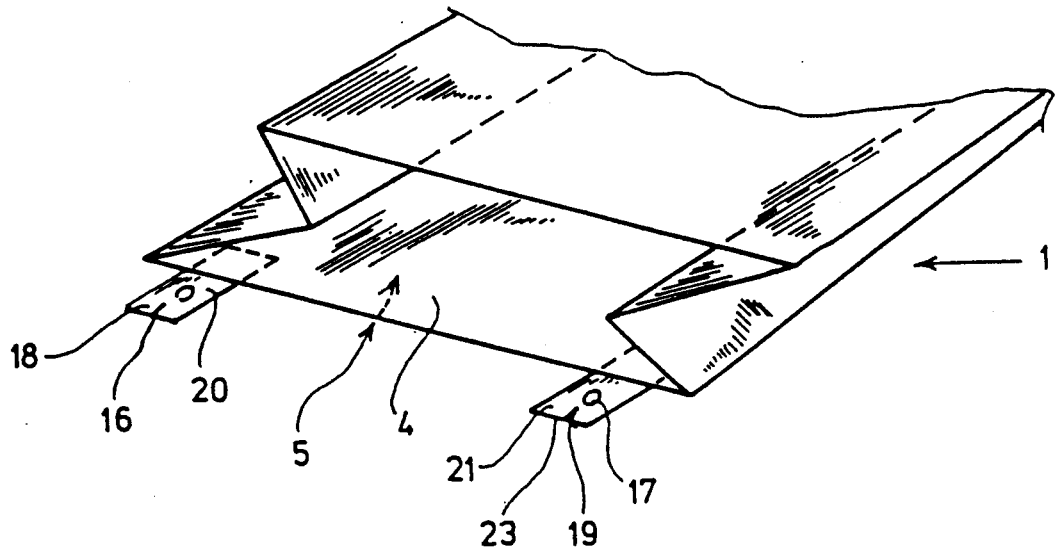
FIG. 2 is a perspective view of a packing bag in its second embodiment (two tabs each having one wicket perforation).

In the embodiment of FIG. 2 the bottom end 4 of the bag is provided with two wicket tabs 20 and 21. The wicket tabs 20 and 21 are glued or heat-sealed to the outer side of bag 1 (only partially represented). The wicket tabs 20 and 21 have a rectangular form; as compared to wicket tab 10 according to FIG. 1, their surface area is sharply reduced. One wicket perforation 16, 17 is punched in approximately the center of the overhanging part of the wicket tab 20 or 21. Furthermore, this embodiment features a short slot 18 or 19 covering half of the distance between an outer edge 23 of the wicket tab 20 or 21 and the wicket perforation 16 or 17. These slots 18 or 19 support the tearing off of the wicket tabs, i.e. the bags from the wicket prongs.

The essential object of this invention, i.e. to mostly minimize the cutting and packing waste, is achieved with the above described bags in a best possible way.

There has thus been shown and described a novel packing bag made from a film tube which fulfills all of the objects and advantages sought therfor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention which is limited only by the claims which follow.

What is claimed is:

1. A packing bag comprising:

tubular material cut to lengths with an open end for filling purposes, which at its open end carries at least one film tab with at least one wicket perforation, the bag having an outer flat top side and having bottom material, said tab being connected to the outer flat side of the bag at tis open end, the bag being made of a film and having inside folded lateral walls, the bag having a weld seam at the outer flat side of the bag near its open end and the tab being made of the same material as the bag and being connected to the outer flat side of the bag, the tab having an additional score line which is situated between the weld seam and the wicket perforation, where parts of the tab which remain with the bag after it is removed or torn off of a wicket can be combined with the bottom material of the bag during closing once the bag is filled.

2. The packing bag according to claim 1, wherein the bag has a cutting edge at an end thereof and the tab is configured as a rectangular strip having a longitudinal side parallel to the cutting edge of the bag.

3. The packing bag according to claim 1, wherein the number of tabs corresponds to the number of wicket perforations and wherein the tabs have one perforation each and are disposed on the flat side of the bag.

4. The packing bag according to claim 1, wherein the tab has an outer edge at an outer end thereof and is provided with a slot starting at the outer edge and covering a part of the distance between the outer edge and wicket perforation in the direction towards the wicket perforation.

* * * * *

UNITED STATES PATENT AND TRADEMARK OFFICE

CERTIFICATE OF CORRECTION

PATENT NO. : 4,988,213

DATED : January 29, 1991

INVENTOR(S) : Helmut Mattle

It is certified that error appears in the above-identified patent and that said Letters Patent is hereby corrected as shown below:

On the title page:

ABSTRACT, line 1, for "filing" read -- filling --.

Column 3, line 27, for "tis" read -- its --.

Signed and Sealed this

Thirty-first Day of May, 1994

Bruce Lehman

*Attest:*

BRUCE LEHMAN

*Attesting Officer*

*Commissioner of Patents and Trademarks*